US011148323B2

(12) United States Patent
Barnes et al.

(10) Patent No.: US 11,148,323 B2
(45) Date of Patent: Oct. 19, 2021

(54) METHOD FOR EXCHANGING MOLDS IN A CONCRETE PRODUCTS FORMING MACHINE

(71) Applicant: Columbia Machine, Inc., Vancouver, WA (US)

(72) Inventors: Joseph Barnes, Battle Ground, WA (US); Stacy Gildersleeve, Woodland, WA (US)

(73) Assignee: Columbia Machine, Inc., Vancouver, WA (US)

( * ) Notice: Subject to any disclaimer, the term of this patent is extended or adjusted under 35 U.S.C. 154(b) by 369 days.

(21) Appl. No.: 16/362,115

(22) Filed: Mar. 22, 2019

(65) Prior Publication Data

US 2019/0217500 A1 Jul. 18, 2019

Related U.S. Application Data

(62) Division of application No. 14/991,669, filed on Jan. 8, 2016, now Pat. No. 10,279,507.

(51) Int. Cl.

| | |
|---|---|
| ***B28B 17/00*** | (2006.01) |
| ***B66C 5/04*** | (2006.01) |
| ***B28B 7/08*** | (2006.01) |

(52) U.S. Cl.

CPC ..... *B28B 17/009* (2013.01); *B66C 5/04* (2013.01); *B28B 7/08* (2013.01)

(58) Field of Classification Search

CPC ..... B28B 17/009; B66C 5/04; B66C 5/06
See application file for complete search history.

(56) References Cited

U.S. PATENT DOCUMENTS

| | | | | |
|---|---|---|---|---|
| 4,025,265 A * | 5/1977 | Auer | B28B 7/08 | 425/211 |
| 4,737,091 A * | 4/1988 | Fiorentini | B23Q 7/1442 | 249/161 |
| 6,499,985 B1 * | 12/2002 | Sekiguchi | B28B 3/028 | 425/186 |
| 6,530,769 B1 * | 3/2003 | Rondeau | B28B 17/009 | 29/428 |

FOREIGN PATENT DOCUMENTS

JP H11192521 A * 7/1999

* cited by examiner

*Primary Examiner* — Jacob T Minskey
*Assistant Examiner* — Virak Nguon

(57) ABSTRACT

A method for exchanging molds in a concrete products forming machine (CPM) comprises moving a first mold cassette assembly along a linear path to a mold receiving position adjacent to a concrete products forming machine. The first mold is then moved out of the CPM along a mold-transfer path perpendicular to the linear path of the first mold cassette assembly. The first mold is then mounted within the first mold cassette assembly which then moves along the linear path out of the mold-receiving position. The second mold cassette assembly, and pre-mounted second mold, are then moved along the linear path to the mold-extracting position. The second mold is then demounted from the second mold cassette assembly and moved along the mold-transfer path to the concrete products forming machine to effect a mold change within the CPM.

17 Claims, 8 Drawing Sheets

METHOD FOR EXCHANGING MOLDS IN A CONCRETE PRODUCTS FORMING MACHINE

CROSS-REFERENCES TO RELATED APPLICATIONS

This application is a divisional application and claims the benefit of U.S. patent application Ser. No. 14/991,669, filed Jan. 8, 2016, whose contents are incorporated herein for all purposes.

BACKGROUND OF THE INVENTION

1. Field of the Invention

This invention relates generally to concrete products forming machines (CPM), and more particularly to methods for assisting in the exchange of one mold assembly with another within such machines.

3. Description of the Prior Art

Prior art machines for forming concrete products within a mold box include a product forming section comprising a stationary frame, an upper compression beam and a lower stripper beam. The mold assembly includes a head assembly that is mounted to the compression beam, and a mold box that is mounted on a vibration system and receives concrete material from a feed drawer. An example of such a system is shown in U.S. Pat. No. 5,807,591 which describes an improved concrete products forming machine (CPM) assigned in common to the assignee of the present application and herein incorporated by reference for all purposes.

In use, the feed drawer moves concrete material over the top of the mold box and dispenses the material into the contoured cavities of the mold box. The feed drawer typically includes an agitator assembly within the drawer that operates to break up the concrete and improve its consistency prior to dropping it into the mold box. As the concrete material is dispensed, a vibration system shakes the mold box to spread the concrete material evenly within the mold box cavities in order to produce a more homogeneous concrete product. A wiper assembly, mounted to the front of the feed drawer, acts to scrape excess concrete from the shoes of the mold head assembly when the feed drawer is moved to and from an operative position above the mold box.

After the concrete is dispensed into the mold cavities, the feed drawer retracts from over the top of the mold box. A spreader, bolted separately to the front of the feed drawer, scrapes off excess concrete from the top of the mold when the feed drawer is retracted after filling the mold cavities. The compression beam then lowers, pushing shoes from the head assembly into corresponding cavities in the mold box. The shoes compress the concrete material during the vibration process. After compression is complete, the stripper beam lowers together with the compression beam as the head assembly pushes further into the cavities against the molded material. A molded concrete product thereby emerges from the bottom of the mold assembly onto a pallet and is conveyed away for curing and a new pallet moved in its place beneath the underside of the mold assembly.

The mold box and head assembly are matched together and configured to form concrete products in a specific shape, size, and number. Each product configuration requires a different mold. When the operator desires the CPM to produce products in different configurations, the mold box must be detached from mounts on the CPM and removed along with the head assembly. A different mold box and head assembly must then be moved into place and mounted within the CPM.

Conventional methods for changing molds out in a CPM are typically labor intensive and result in a lot of downtime with the machine, leading to lost revenue. Accordingly, there is need for an improved system and method for better automating the process for changing molds within a concrete products forming machine that minimizes these drawbacks.

SUMMARY OF THE INVENTION

A mold transfer assembly comprises a carriage assembly configured to be placed adjacent to a concrete products forming machine. The carriage assembly has a track running along a mold-transfer path perpendicular to the mold-receiving path. Each of at least two mold cassette assemblies running within the track are configured to retain a mold assembly, wherein the mold cassette assemblies are configured to move along the track between a retracted position spaced from the mold-receiving path adjacent to the concrete products forming machine, and two positions intersecting the mold-receiving path including an incoming mold cassette position, and an outgoing mold cassette position.

The invention also comprising methods for exchanging molds in a concrete products forming machine using a mold transfer assembly of a type having a track running on a linear path along which is mounted a carriage assembly coupled to first and second spaced mold cassette assemblies.

A first method comprises moving the first mold cassette assembly along the linear path to a mold receiving position adjacent to a concrete products forming machine. The first mold is then moved out of a concrete products forming machine along a mold-transfer path perpendicular to the linear path of the first mold cassette assembly to a mold-receiving position. The first mold is then mounted within the first mold cassette assembly. After mounting the first mold, the first mold cassette assembly is moved along the linear path out of the mold-receiving position. The second mold cassette assembly, and pre-mounted second mold, are then moved along the linear path to the mold-extracting position. The second mold is then demounted from the second mold cassette assembly and moved along the mold-transfer path to the concrete products forming machine to effect a mold change within the CPM.

A second aspect of the invention involves moving molds to a loading position adjacent a concrete products forming machine of a type having a mold-receiving cavity and a mold-receiving path to the mold-receiving cavity. The inventive method comprises mounting first and second mold assemblies within respective first and second mold cassette assemblies, and mounting the first and second mold cassette assemblies in spaced relation to one another along a carriage assembly. The first and second mold cassette assemblies are moved along a mold transfer path between a retracted position spaced from the concrete products forming machine and respective first and second positions adjacent the concrete products machine to thereby present the first and second mold assemblies one at a time to the loading position intersecting the mold-receiving path.

In a third aspect of the invention, a plurality of mold assemblies are moved to a loading position adjacent a concrete products forming machine for selective installation of one of the plurality of mold assemblies along a mold-receiving path into the concrete products forming machine.

The method includes mounting first and second mold assemblies in common to a carriage assembly and driving the carriage assembly along an overhead track via a drive motor so that the first and second mold assemblies move between a retracted position spaced from the concrete products forming machine and respective first and second positions adjacent the concrete products machine to thereby present the first and second mold assemblies one at a time to the loading position intersecting the mold-receiving path. Positional movement of the carriage along the track is detected and the drive motor operated responsive to this detected positional movement.

An advantage of the invention is that it enables a mold assembly to be removed from the machine automatically and without use of hand tools or external overhead lifting devices, providing an increased isolation of the operator from the dangers associated with most mold change processes of industrial concrete product forming machines. This invention has the advantage of requiring only a single axis of motion to transport the mold assemblies to and from the concrete products forming machine (CPM). An additional advantage of this system is its modular nature, allowing it to be added to an existing CPM setup.

The foregoing and other objects, features and advantages of the invention will become more readily apparent from the following detailed description of a preferred embodiment of the invention that proceeds with reference to the accompanying drawings.

DETAILED DESCRIPTION

Figure 1:
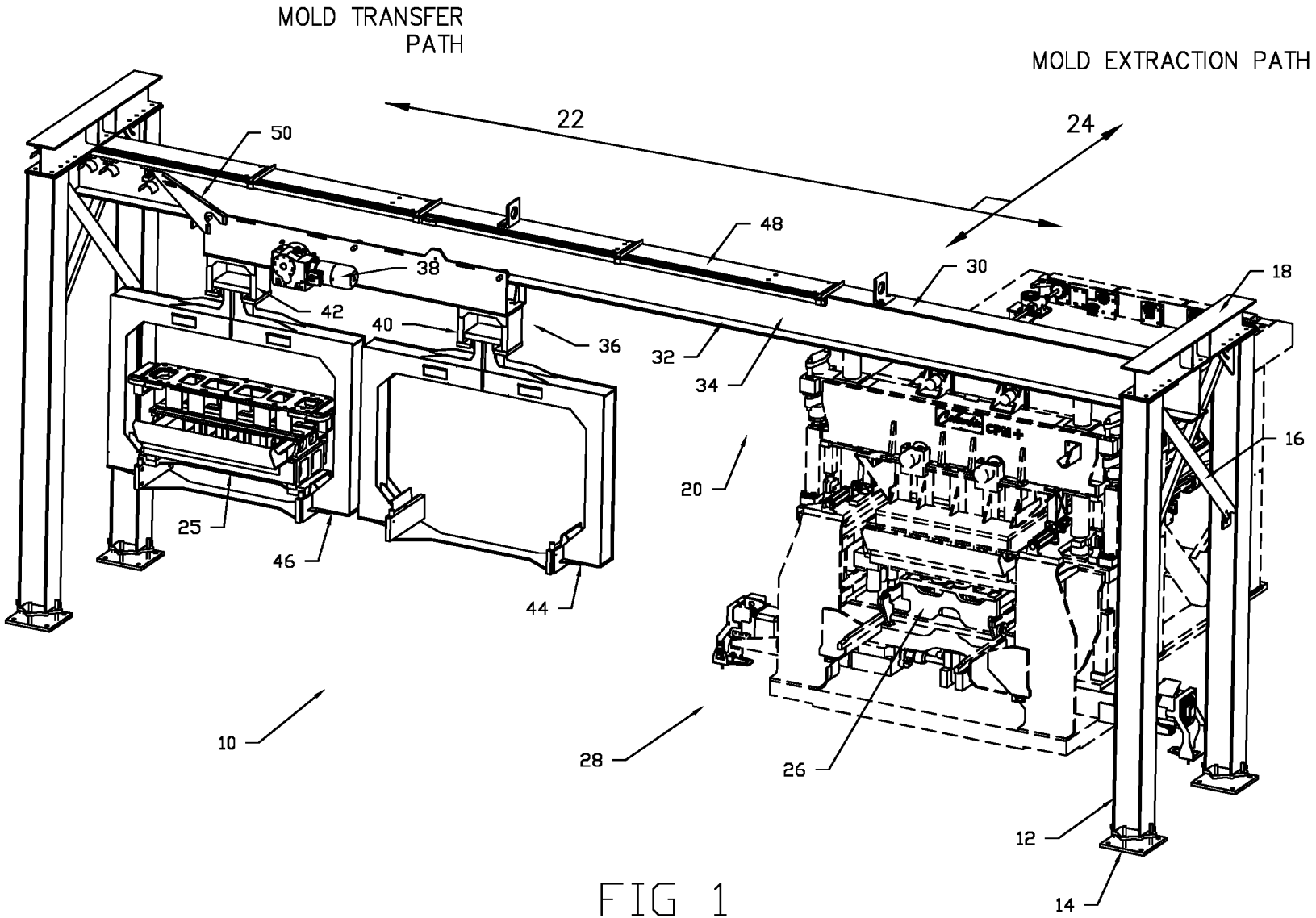
FIG. 1 is perspective view of a mold transfer assembly implemented according to teachings of the invention with mold cassettes in a retracted position, a concrete products forming machine (CPM) being shown in dashed outline.

FIG. 1 illustrates a mold transfer assembly, also referred to as a carriage assembly 10, as constructed according to preferred embodiments of the invention. Mold transfer assembly 10 includes two pairs of uprights, such as legs 12, positioned on either side of the assembly. Each upright 12 includes a footing 14, with the pair coupled together via cross-bracing struts 16 and a top-mount cross beam 18. An I-beam 20 is coupled to the underside of each cross beam 18 to thereby tie the uprights and cross beams together. As explained further below, the I-beam 20 forms a track along which a mold assembly, such as mold assembly 25, is carried by the mold transfer assembly and therefore defines an axial mold transfer path 22. The assembly 10 is set up so that the mold transfer path 22 is perpendicular to a mold extraction path 24 along which a mold assembly, such as assembly 26, is removed from the concrete products forming machine 28. These structures combined form the structural frame of the mold transfer assembly 10.

Turning also to FIGS. 2-5, track I-beam 20 includes a top flange 30 and spaced, parallel bottom flange 32 coupled together via a vertical member 34. A mold transfer carriage assembly 36 rolls atop the bottom flange 32 of I-beam 20 under power of motor 38 and carries a pair of hangers 40, 42 from which a pair of mold cassette assemblies 44, 46 hang in fixed relation to one another. A downwardly directed, secondary track 48 sits atop the top flange 30. A tow trolley, coupled to a rear of the mold transfer carriage assembly 36 runs within a slot on track 48 in parallel relation with the mold transfer path 22.

FIG. 1 illustrates the mold transfer assembly 10—and particularly the cassette assemblies 44, 46—in a home or retracted position. In such a position, the cassettes 44, 46 are moved away from the mold extraction path to the far left position. Mold assembly 26 is shown already installed in CPM 28 to form molded concrete products of a first-type of configuration and size. The mold assembly 25 shown mounted within cassette 46 would typically have a different configuration and size from mold assembly 26. As will be described below, the cassettes 44, 46 move via the mold transfer carriage assembly 36 along I-beam 20 to positions adjacent to CPM 28 to first receive the currently mounted mold assembly 26 within currently empty cassette 44 (see FIG. 5), and then deliver the second mold assembly 25 to the CPM 28. This loading process involves instructions for moving right from a retracted position to a first loading position, loading the mold assembly 26 onto cassette 44, then moving further right to a second loading position, and then delivering the second mold assembly 25 to the CPM 28.

The invention thus consists of a mold transfer carriage assembly 36 that transports one or more removable mold cassette assemblies 44, 46 in a single axis of motion, where the removable mold cassette assemblies carry mold assemblies 25, 26.

Figure 2:
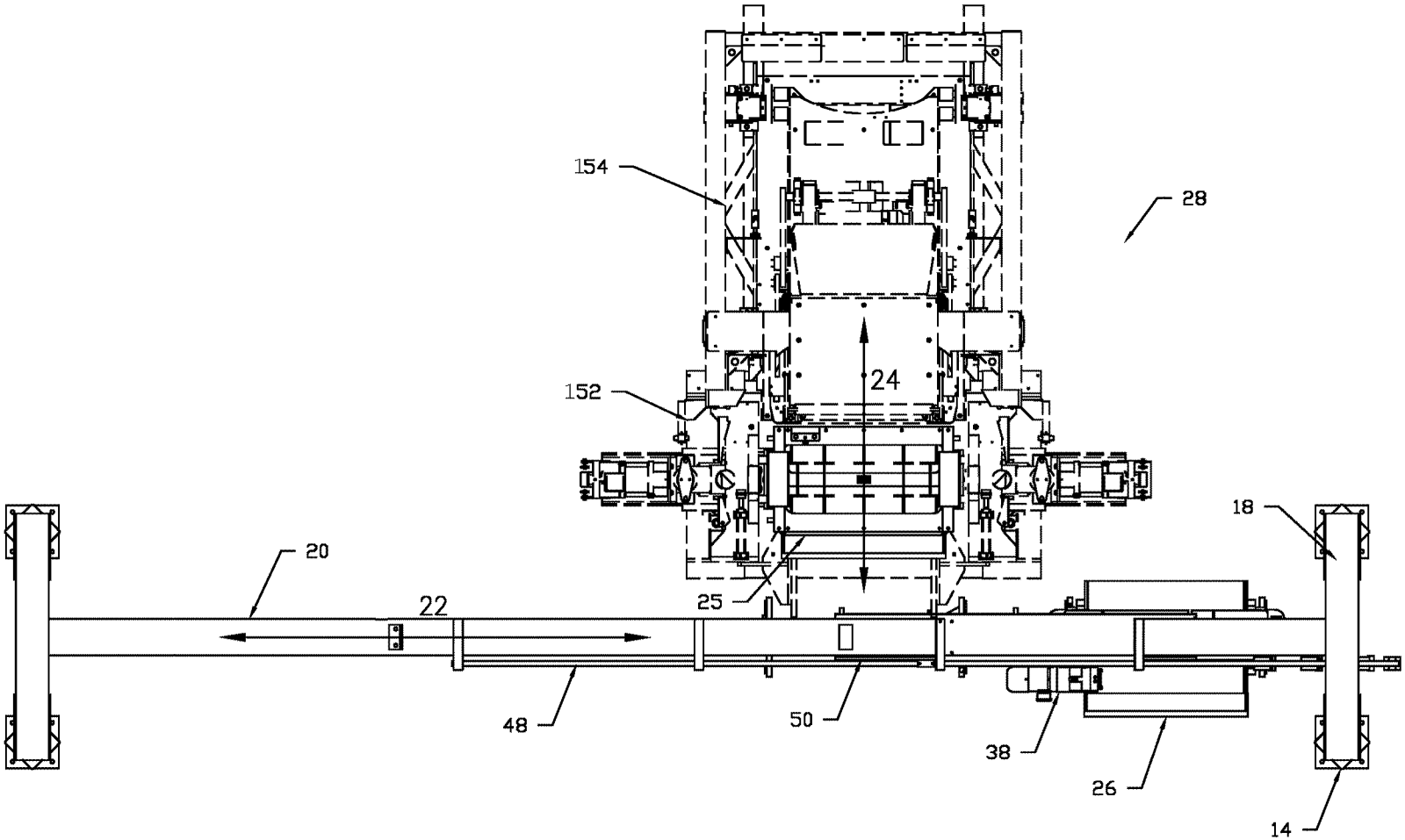
FIG. 2 is a plan view of the mold transfer assembly and CPM of FIG. 1 in a mold-supplying position.

FIG. 2 shows an overhead/plan view of the mold transfer assembly 10 in relation to the concrete products forming machine (CPM) 28. CPM 28 would generally include a concrete products forming center section 152 on which the mold, such as mold assembly 25, is mounted, and a rear section 154 in which a feed drawer assembly is mounted for supplying concrete to the mold assembly 25. The feed drawer moves parallel with the mold transfer path 24, which itself is perpendicular to the plane of movement 22 of the mold assemblies on the mold transfer assembly 10. FIG. 2 illustrates the mold transfer step whereby the first mold 26 has already been removed from the machine along extraction path 24, and the second mold moved along path 24 for mounting within CPM 28.

Figure 3:
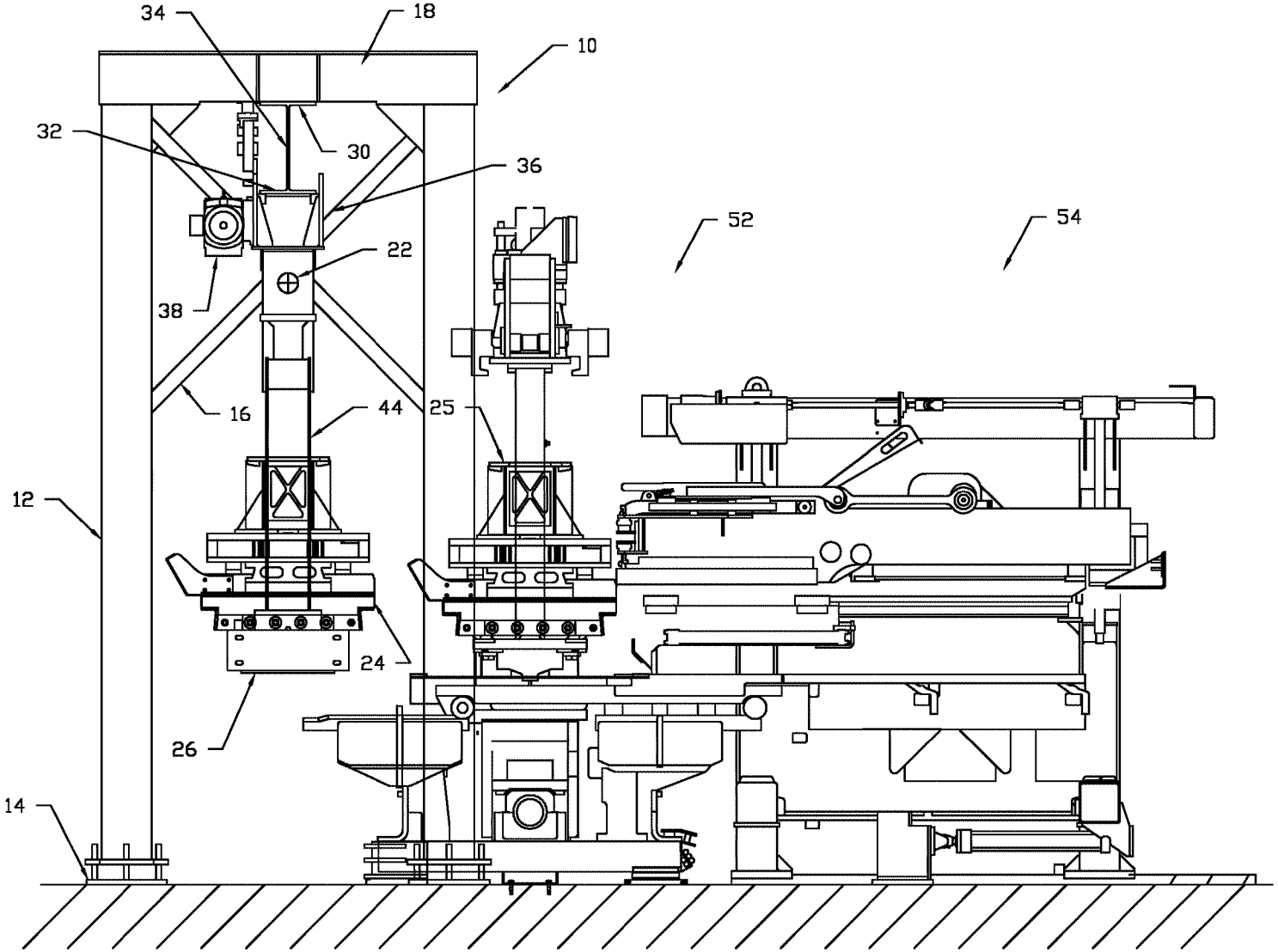
FIG. 3 is a side elevation view of the mold transfer assembly and CPM of FIG. 2 in partial section.

FIG. 3 shows a side elevation view of the assembly of FIG. 2 with one mold assembly 25 mounted within CPM 28 and another mold assembly 26 mounted within the mold transfer cassette 44. A mold extraction arm (not shown) would pick up the mold assembly 25 from vibration system mounts on CPM 28 and carry it leftward toward assembly 10 along path 24. The mold extraction arm would then be lowered, placing the mold assembly 25 onto the mold transfer cassette 44, then retracting the extraction arms rightward. The cassettes would then move into/out-of the page to present a different mold assembly 26 for mounting on CPM 28. The mold extraction arm would complete a reverse process by extending, lifting and picking up the mold 26 from cassette 44 and moving it to the right onto vibration system mounts on CPM 28. In this fashion, the mold change process can be better automated to minimize downtime.

The mold transfer carriage assembly has three discreet positions. The first position is in the fully retracted position. In this first position only one of the mold cassette assemblies contains a mold assembly. The second position is when the empty mold cassette assembly is located directly in front of the concrete products forming machine ready to receive the mold assembly being extracted from the concrete products forming machine by the mold extractor assembly. The third position is when the mold cassette assembly containing the new mold assembly is located directly in front of the concrete products forming machine allowing the mold extractor assembly to insert the new mold assembly into the concrete products forming machine.

Figure 4:
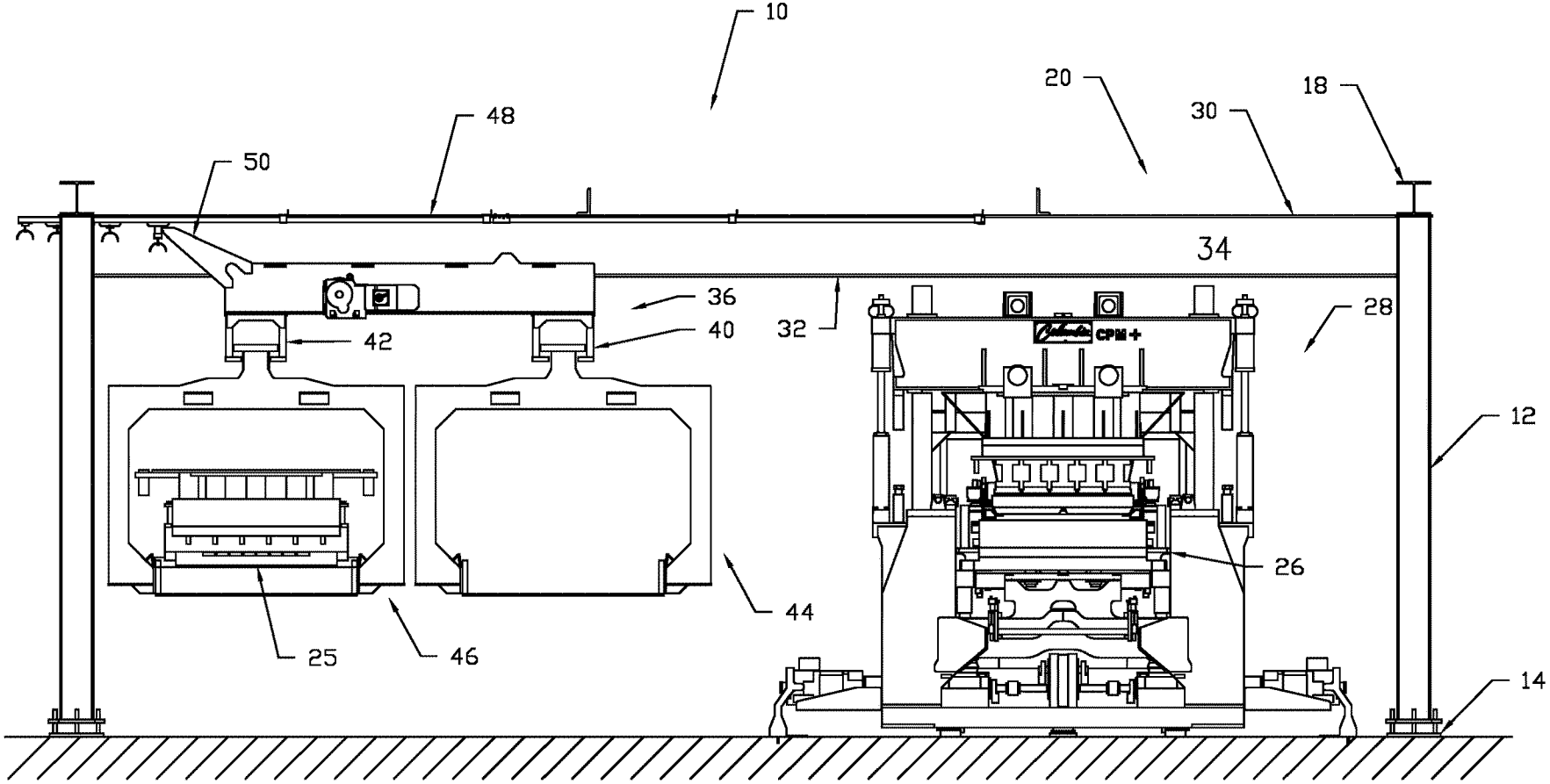
FIG. 4 is a front elevation view of the mold transfer assembly and CPM of FIG. 1 with the cassettes in a retracted position.
Figure 5:
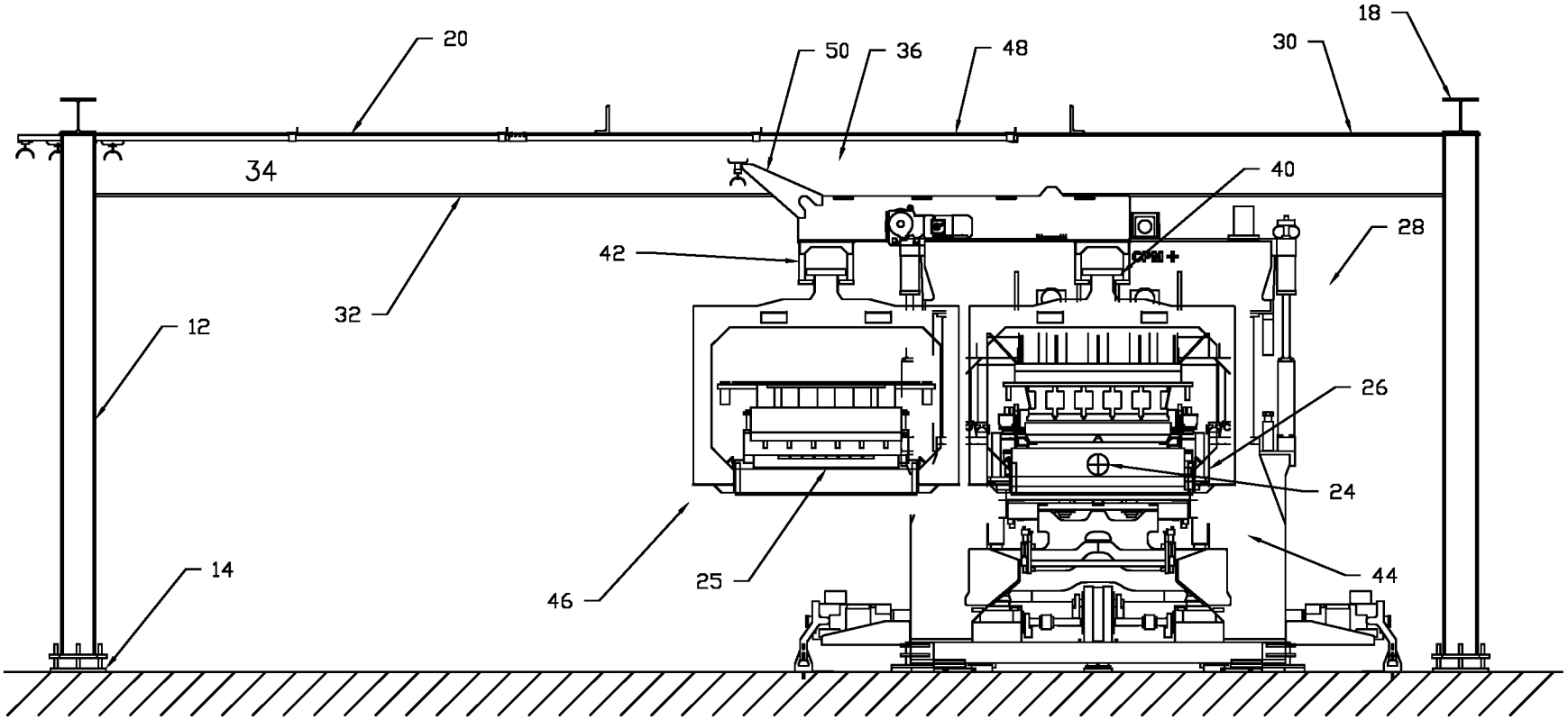
FIG. 5 is a front elevation view of the mold transfer assembly and CPM of FIG. 1 with the cassettes moved to a mold-receiving position.
Figure 6:
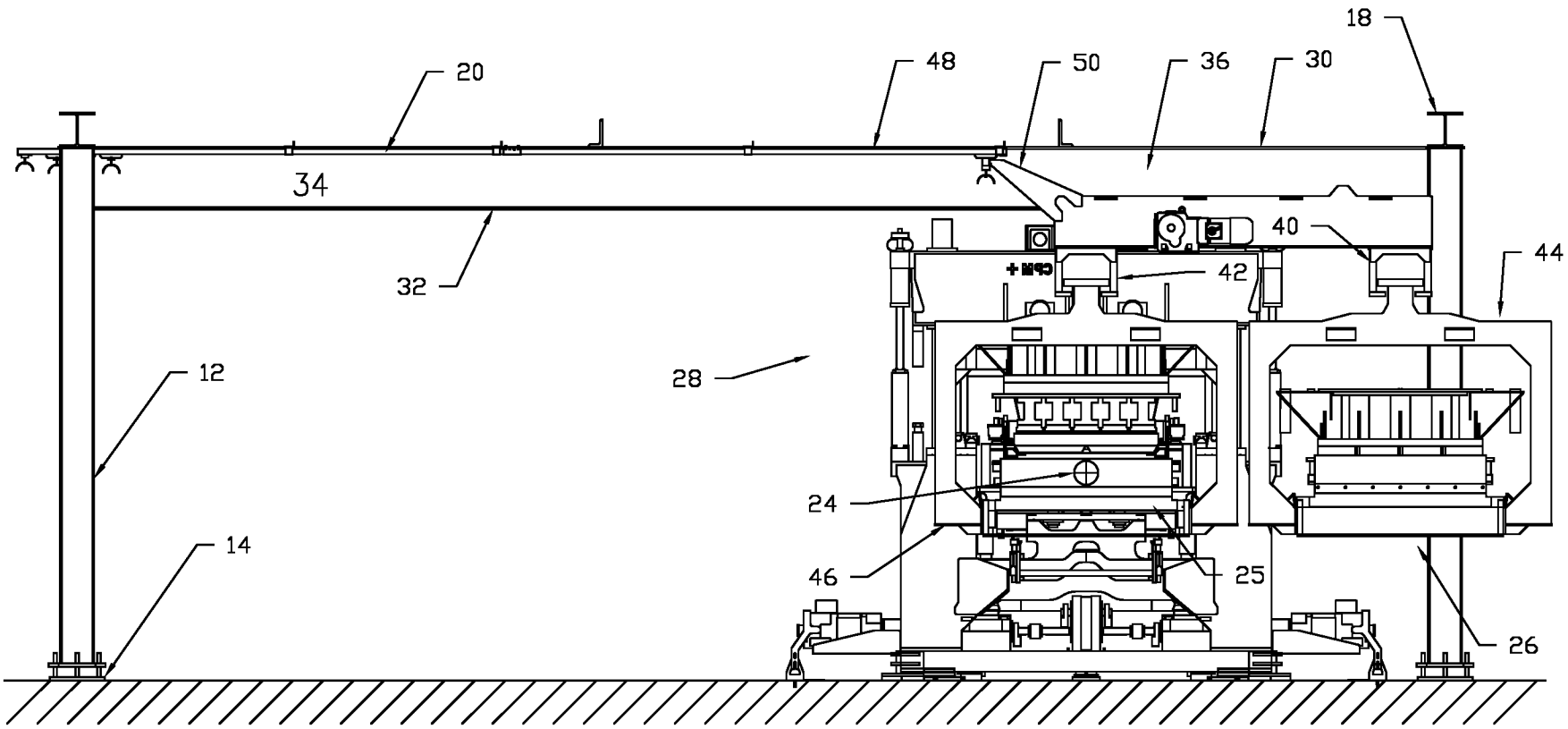
FIG. 6 is a front elevation view of the mold transfer assembly and CPM of FIG. 1 with the cassettes moved to a mold-supplying position.

FIGS. 4-6 illustrate the three main positions of the mold transfer assembly. FIG. 4 shows the home or retracted position where the cassettes 44, 46 are moved away from adjacency with the CPM 28 (e.g. all the way to the left). FIG. 5 shows the mold transfer assembly 10 in a first loading position where cassette 44 is aligned with the mold extraction path 24. In this first loading position, mold 26 may be extracted from CPM 28 along mold extraction path 24 and placed on cassette 44 for storage. The mold transfer assembly 10 would then move to the second loading position as shown in FIG. 6 where the cassettes 44, 46 are moved to their far right position. Cassette 46 is moved to the position vacated previously by cassette 44 so that the cassette 46 is aligned with the mold extraction path 24. The mold 25 loaded onto cassette 46 is then moved along extraction path 24 by a mold extraction device to a mounted position on CPM 28 for production.

Figure 7B:
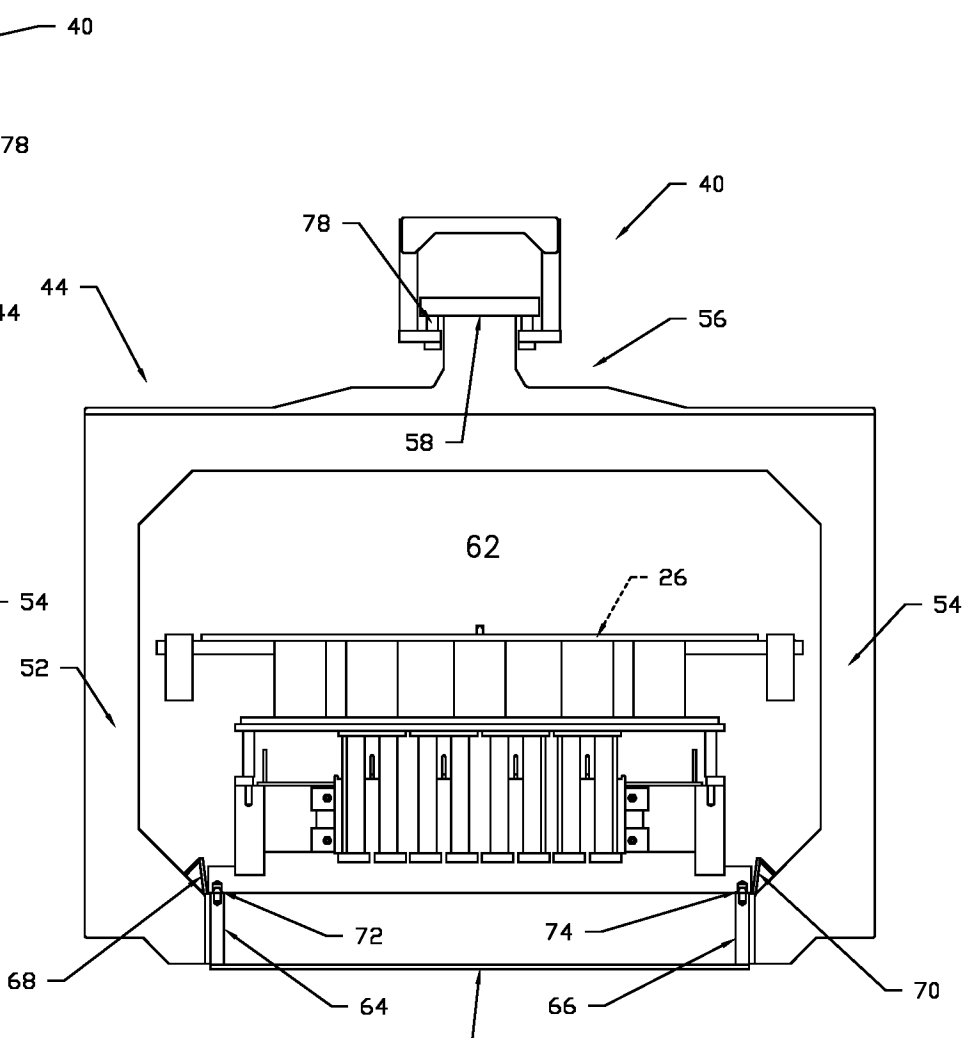
FIGS. 7A and 7B show perspective and front elevation views, respectively, of the mold cassette assembly used in the mold transfer assembly of FIG. 1, a carried mold being shown in dashed outline in FIG. 7B.
Figure 7A:
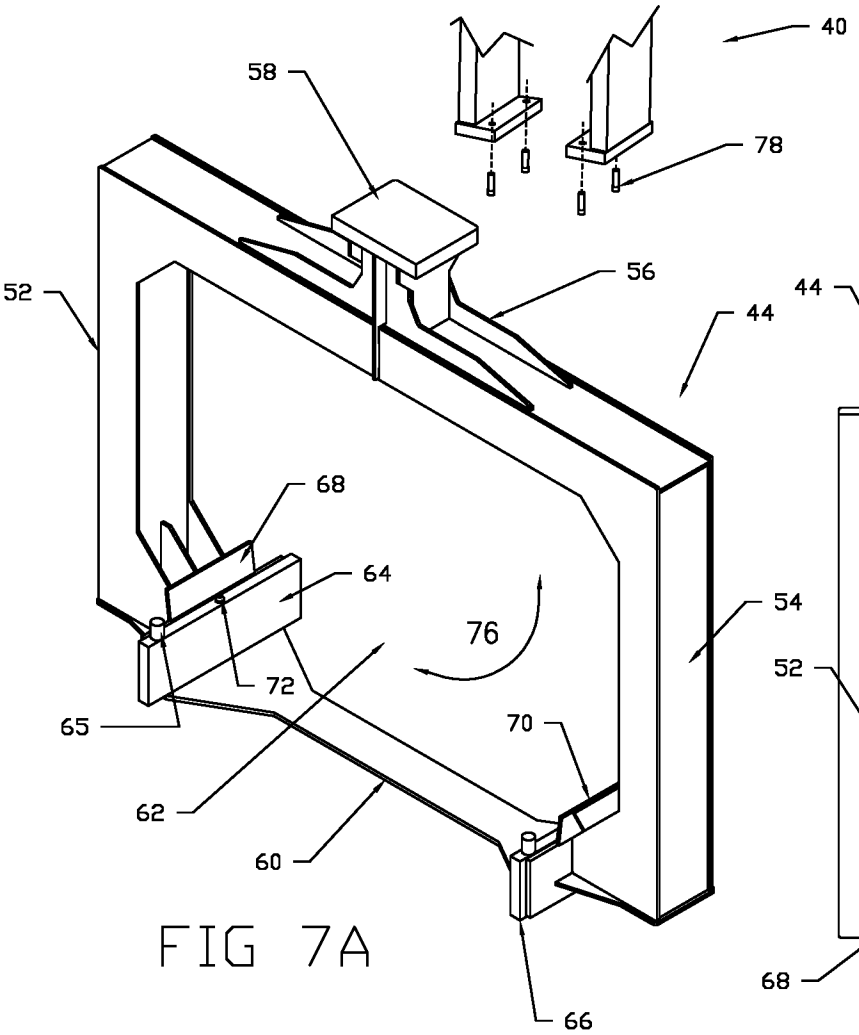

FIGS. 7A and 7B show details of the cassette 44 used in mold transfer assembly 10. Cassette 44 includes two C-shaped frame sections 52, 54 coupled together at the top by a central weldment post 56 on which sits a top plate 58. Cassette frame sections 52, 54 are coupled together at the bottom by a spreader plate 60 that maintains the spacing between the frame sections. Spreader plate is located at the lowest portion of the cassette 44 so as to provide a large central opening 62 within the cassette through which a mold assembly, such as assembly 26 (FIG. 7B), may be received.

The mold cassette assembly is loosely constrained on the mold carriage assembly in such a way that when the mold assembly is being placed on or removed from a mold cassette assembly by the mold extractor assembly, the tapered alignment block pockets in the underside of the mold assembly can easily align to the tapered alignment blocks of the mold extractor assembly by means of the mold cassette assembly being able to tilt slightly on its mount point(s) in the same direction of travel as the mold extractor assembly. The angle of tilt is slight enough due to the geometry of the mold cassette assembly to align the mold assembly to the mold cassette assembly stop spacer 65 without causing binding. Tapered surfaces and other means of adjustment are also provided on the mold cassette assembly to ensure proper engagement of the tapered alignment block pockets to the tapered alignment blocks. This compliance also allows the cassette to move slightly when the mold assembly is set onto the cassette, which allows the tapered alignment blocks to move the cassette slightly if needed. This helps by not requiring exacting positions for placing the mold assembly onto the cassette.

Coupled on either side of the spreader plate 60 are features configured to guide and retain a mold assembly within the cassette. A pair of shelves 64, 66 are spaced on each side of the spreader plate 60. The shelves are spaced an identical distance apart as the shelves on CPM 28 to which the mold assemblies are operatively mounted to the vibration system. The pair of shelves 64, 66 are separated by a central expanse configured to receive the forks of a mold exchange assembly, noting that the spreader plate 60 is located below the top surface of the shelves.

A pair of inwardly sloped guide plates 68, 70 are coupled to outside peripheral sections of the shelves. These plates 68, 70 are angled from a wider top spacing to a narrower bottom spacing and are configured to provide surfaces that guide the mold onto the shelves. Mold alignment pins, such as dowels 72 and 74, are centrally located on a top surface of each of the shelves 64, 66. In use, a mold extraction device would lift mold assembly 26 from the shelves on CPM 28 and carry it through the opening 62 of cassette 44. The mold extraction device would then lower the mold assembly 26 onto cassette shelves 64, 66 so that apertures on an underside of the mold assembly receive dowels 72, 74.

Movement of the mold assembly to and from the cassettes has been found to create a rocking movement, shown by arc 76. To accommodate this movement, the cassette top plate 58 sits loosely on shelves within a pocket of hanger 40 on four adjusting bolts 78 that stick up in the receiver section of the hanger 40 and are received through complementary apertures 80 formed up through the bottom thereof. These adjusting bolts 78 allow one to level the cassette while still allowing for the rocking movement 76. The hangers 40, 42 thus provide a receiver for each mold cassette assembly that allows for tool-less insertion and removal as well as compliance to allow a mold cassette assembly to tilt slightly when a mold assembly is inserted or removed from the mold cassette assembly.

Figure 8B:
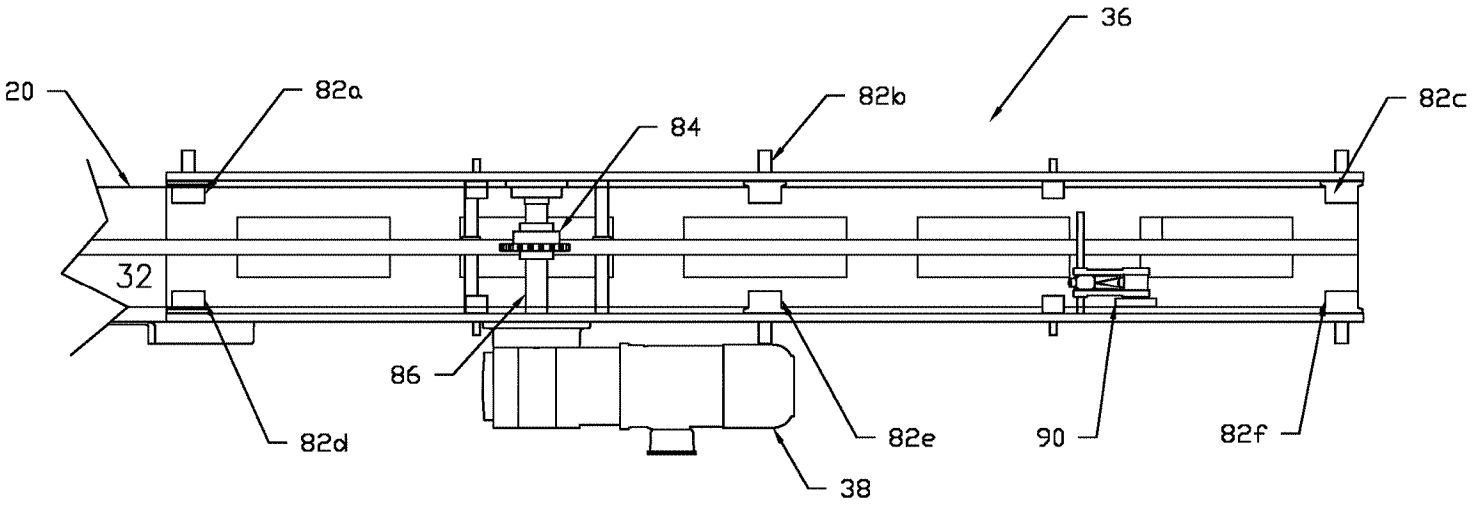
FIGS. 8A and 8B show underside and rear elevation views, respectively, and in partial section, of the carriage assembly and monorail adapted to move the cassettes between the positions of FIGS. 4-6.
Figure 8A:
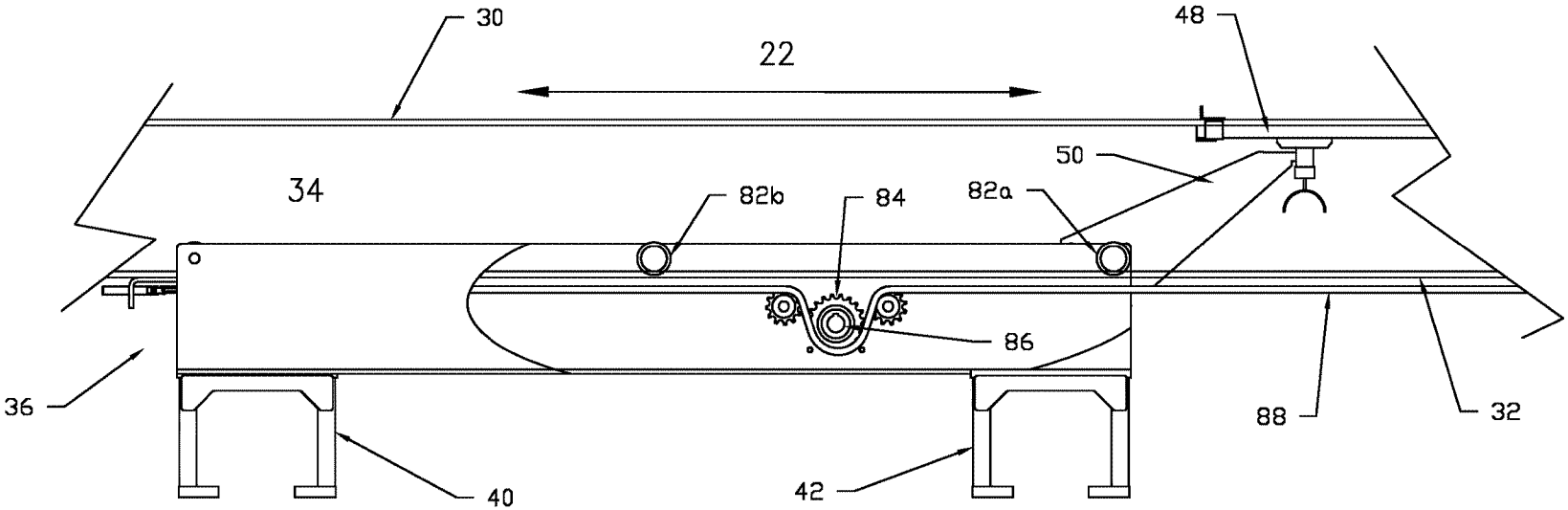

FIGS. 8A and 8B show features for moving the cassettes 44, 46 laterally along the mold transfer path 22 of the mold transfer device 10. FIG. 8A shows an underside plan view of the mold transfer carriage assembly 36 carrying the cassettes 44, 46 in a fixed spaced relation to one another. Carriage assembly 36 rides on a set of rollers 82*a*-82*f* that sit atop the bottom flange 32 of I-beam 20. The structure approximates a hanging monorail structure so that the cassettes and mounted mold assemblies may be carried from above. An electric gear drive motor 38 drives a sprocket 84 attached to a drive axle 86 passing perpendicular to the plane 22 of the mold transfer path. A chain 88 is mounted to and runs along a substantial length of I-beam 20, passing through the carriage assembly 36 and over the teeth of the sprocket 84. Rotation of the sprocket 84 by motor 38 moves the carriage assembly 36 along the length of the chain 88. A rotary encoder 90 rides on the carriage assembly 36 and is driven off of the I-beam 20 to provide positional information of the carriage assembly. This information is fed to a computer system controlling the motor 38 to thereby move the carriage assembly and cassettes 44, 46 to precisely defined retracted and loading positions. The positions from the encoder 90 thus tell the operator when the carriage assembly is in the home position (FIG. 4), the mold removal position (FIG. 5), and the mold insertion positions (FIG. 6). To help deliver power between the carriage assembly 36 and the computer control system, a tow bar 50 is coupled to an upper track 48 affixed to the top flange 30 of I-beam 20, thus forming a tow trolley structure that rides along the upper flange.

The mold transfer assembly enables some unique and useful features in the art of concrete products forming devices. First, the mold cassette assemblies in the mold transfer assembly is unique in that operators can either place and remove mold assemblies in the mold cassette assemblies or they can transfer mold assemblies in the mold cassette assemblies by removing the cassettes with mold assemblies from the mold transfer carriage assembly. Second, the mold transfer assembly is unique in that it requires movement and actuation in only one axis. This simplifies the assembly and makes the option very competitive at one third the cost of previous systems. Furthermore, the mold transfer assembly is a simpler system with fewer actuators and moves making it a more reliable system.

The method for exchanging molds in a concrete products forming machine 28 uses a mold transfer assembly 10 of a type having a track running 20 on a linear path 22 along which is mounted to a carriage assembly 36 and coupled to first and second spaced mold cassette assemblies 44, 46. The method comprises moving the first mold cassette assembly 44 along the linear path to a mold receiving position (FIG. 5) adjacent to a concrete products forming machine 28. The first mold 26 is then moved out of a concrete products forming machine 28 along a mold-transfer path 24 perpendicular to the linear path 22 of the first mold cassette assembly 44 to a mold-receiving position. The first mold 26 is then mounted within the first mold cassette assembly 44. After mounting the first mold 26, the first mold cassette assembly 44 is moved along the linear path 22 out of the mold-receiving position. The second mold cassette assembly 46, and pre-mounted second mold 25, are then moved along the linear path 22 to the mold-receiving position (FIG. 6). The second mold 25 is then demounted from the second mold cassette assembly 46 and moved along the mold-transfer path 24 to the concrete products forming machine 28 to effect a mold change within the CPM.

Alternate aspects of the inventive method include moving the first and second mold cassette assemblies in common along the linear path a fixed distance from one another. In another aspect, the inventive method includes implementing the moving steps under automated computer control responsive to computer instructions implementing a mold change command. Alternately, the inventive method can include the step of accommodating a tilt of the first mold cassette assembly in a same direction as the mold-transfer path during the mounting step as by using the hanger assembly shown in FIGS. 7A and 7B.

Having described and illustrated the principles of the invention in a preferred embodiment thereof, it should be apparent that the invention can be modified in arrangement and detail without departing from such principles. For instance, the invention is not limited to two cassette assemblies but can have any number of cassette assemblies and corresponding mold assemblies. Furthermore, it is preferred but not necessary to the teachings of the invention that the cassette assemblies be configured to move along the track while coupled a fixed distance from one another so that the cassette assemblies move in common during movement between the retracted position and the two or more loading positions. Additionally, the mold transfer path may allow the mold elevations to be different from the home position and the mold transfer path not perpendicular to the mold extraction path. We claim all modifications and variation coming within the spirit and scope of the following claims.

What is claimed is:

1. A method for moving molds to a loading position adjacent a concrete products forming machine of a type having a mold-receiving cavity and a mold-receiving path to the mold-receiving cavity, the method comprising:

mounting first and second mold assemblies within respective first and second mold cassette assemblies;

mounting the first and second mold cassette assemblies in spaced relation to one another along a carriage assembly; and moving the first and second mold cassette assemblies along a mold transfer path between a retracted position spaced from the concrete products forming machine and respective first and second positions adjacent the concrete products machine to thereby present the first and second mold assemblies one at a time to the loading position intersecting the mold-receiving path.

2. The method of claim 1, further including the step of demounting one of the first and second mold assemblies at the loading position and installing it within the mold receiving cavity of the concrete products forming machine.

3. The method of claim 2, wherein the step of moving the first and second mold cassette assemblies includes moving the mold cassette assemblies perpendicular to the mold-receiving path.

4. The method of claim 2, further including the step of receiving at a respective first or second cassette assembly the demounted one of the first and second mold assemblies from the concrete products forming machine along the mold-receiving path and moving the respective first or second cassette assembly along the mold transfer path out from the loading position.

5. The method of claim 4, further including, and after the step of moving the respective first or second cassette assembly along the mold transfer path out from the loading position, moving the other of the first and second mold assemblies to the loading position and demounting the other of the first and second mold assemblies at the loading position and installing it within the mold receiving cavity of the concrete products forming machine.

6. The method of claim 1, further including the step of moving the first and second mold cassette assemblies in common and in fixed relation to one another during movement between the retracted position and the first and second positions.

7. The method of claim 1, further including the step of moving the first and second mold cassette assemblies along an overhead track between the retracted position spaced from the concrete products forming machine and the respective first and second positions adjacent the concrete products machine.

8. The method of claim 7, further including the step of coupling a mold transfer carriage to the overhead track and coupling the first and second mold cassette assemblies in fixed relation to one another to the mold transfer carriage.

9. A method for moving a plurality of mold assemblies to a loading position adjacent a concrete products forming machine for selective installation of one of the plurality of mold assemblies along a mold-receiving path into the concrete products forming machine, the method including:

mounting first and second mold assemblies in common to a carriage assembly;

driving the carriage assembly along an overhead track via a drive motor so that the first and second mold assemblies move between a retracted position spaced from the concrete products forming machine and respective first and second positions adjacent the concrete products machine to thereby present the first and second mold assemblies one at a time to the loading position intersecting the mold-receiving path; and detecting positional movement of the carriage along the track and operating said drive motor in response to said detected positional movement.

10. The method of claim 9, further including:

mounting first and second mold assemblies within respective first and second mold cassette assemblies; and mounting the first and second mold cassette assemblies in spaced relation to one another along the carriage assembly.

11. The method of claim 10, further including the step of providing on each of the first and second mold cassette assemblies a hanger having a pair of spaced, lower hanger shelves with an opening therebetween and receiving the first and second mold assembly between the lower hanger shelves.

12. The method of claim 11, wherein the lower hanger shelves include tapered guide surfaces located on the outside of the shelves angled from a wider top spacing to a narrower bottom spacing configured to guide the mold onto the shelves, the method including using the tapered guide surfaces to guide the first and second mold assemblies onto the shelves of respective first and second mold cassette assemblies.

13. The method of claim 11, wherein the lower hanger shelves include mold alignment dowels , the method further including receiving the mold alignment dowels within apertures formed in undersides of the mounted mold assemblies.

14. A method for exchanging molds in a concrete products forming machine using a mold transfer assembly of a type having a track running on a mold-transfer path along which is mounted a carriage assembly coupled to first and second spaced mold cassette assemblies, the method comprising:

moving the first mold cassette assembly along the mold-transfer path to a mold receiving position adjacent a concrete products forming machine;

moving a first mold out of the concrete products forming machine along a mold-transfer path perpendicular to the mold-transfer path of the first mold cassette assembly to a mold-receiving position;

mounting the first mold within the first mold cassette assembly;

after mounting the first mold, moving the first mold cassette assembly along the mold-transfer path out of the mold-receiving position and moving a second mold cassette assembly and pre-mounted second mold along the mold-transfer path to the mold-receiving position; and demounting the second mold from the second mold cassette assembly and moving the second mold along the mold-transfer path to the concrete products forming machine.

15. The method of claim 14, further including the step of moving the first and second mold cassette assemblies in common along the mold-transfer path a fixed distance from one another.

16. The method of claim 14, wherein the steps of moving the first mold cassette assembly and moving the first mold occur under automated computer control responsive to computer instructions implementing a mold change command.

17. The method of claim 14, further including the step of resting a top plate of the mold cassette assembly on shelves within a hanger with an opening arranged with parallel with a mold load-unload path to accommodate tilting the first mold cassette assembly in a same direction as the mold-transfer path during the mounting step.

* * * * *